US010696432B2

(12) United States Patent
Levy

(10) Patent No.: US 10,696,432 B2
(45) Date of Patent: Jun. 30, 2020

(54) CONTAINER WITH PRODUCT REMOVAL MECHANISM

(71) Applicant: STUPID GOOD BEVERAGE COMPANY, LLC, Santa Barbara, CA (US)

(72) Inventor: Dorian Levy, Santa Barbara, CA (US)

(73) Assignee: STUPID GOOD BEVERAGE COMPANY, LLC, Santa Barbara, CA (US)

( * ) Notice: Subject to any disclaimer, the term of this patent is extended or adjusted under 35 U.S.C. 154(b) by 0 days.

(21) Appl. No.: 15/189,267

(22) Filed: Jun. 22, 2016

(65) Prior Publication Data

US 2017/0369198 A1 Dec. 28, 2017

(51) Int. Cl.

| | |
|---|---|
| ***B65B 3/02*** | (2006.01) |
| ***A47G 19/22*** | (2006.01) |
| ***B65D 85/72*** | (2006.01) |
| ***B65B 3/04*** | (2006.01) |
| ***A47G 19/00*** | (2006.01) |
| ***B65D 83/00*** | (2006.01) |

(52) U.S. Cl.

CPC ..... *B65B 3/02* (2013.01); *A47G 19/00* (2013.01); *A47G 19/22* (2013.01); *A47G 19/2227* (2013.01); *B65B 3/04* (2013.01); *B65D 83/0055* (2013.01); *B65D 85/72* (2013.01)

(58) Field of Classification Search

CPC . B65D 1/32; B65D 1/40; B65D 25/38; B65D 85/72; B65D 83/0055; B65D 83/0005; B65D 83/0094; B65D 2231/027; B65D 21/068; B65D 21/086; A47G 19/2205

USPC ..... 206/804; 221/260; 220/609, 624; 426/11, 130

See application file for complete search history.

(56) References Cited

U.S. PATENT DOCUMENTS

| | | | | |
|---|---|---|---|---|
| 1,428,705 A * | 9/1922 | Pickens | B65D 7/46 | 220/203.04 |
| 1,499,239 A * | 6/1924 | Malmquist | B65B 31/025 | 220/624 |
| 1,762,903 A * | 6/1930 | Werder | F16N 19/00 | 220/624 |
| 2,005,245 A * | 6/1935 | Stover | A23G 9/045 | 229/5.5 |
| 2,053,711 A * | 9/1936 | Glomb | A23G 9/221 | 249/120 |
| 2,124,959 A * | 7/1938 | Vogel | B65B 31/00 | 220/624 |
| 2,208,744 A * | 7/1940 | Bergerioux | B65D 83/0094 | 215/370 |

(Continued)

FOREIGN PATENT DOCUMENTS

EP 0426506 A1 * 5/1991 ..... B65D 1/32

*Primary Examiner* — Patrick M. Buechner

(74) *Attorney, Agent, or Firm* — David V. Rossi; Haug Partners LLP

(57) ABSTRACT

The container for easily dispensing contents with an open top end, a closed bottom surface, and sloped side walls. The closed bottom surface being substantially spherical in shape and connected to the side walls by a flexible hinge. When pressure or force is applied to the bottom surface's spherical shape, that bottom surface flexes or bends from a first stable convex position to a second stable concave position. The transition from the convex to concave position can dislodge contents within the container for consumption without the need of a spoon or other devices.

19 Claims, 4 Drawing Sheets

(56) References Cited

U.S. PATENT DOCUMENTS 2,982,440 A * 5/1961 Harrison ..... B65D 1/265 220/609
3,403,714 A * 10/1968 Hulm ..... B65D 50/065 206/438
3,409,167 A * 11/1968 Blanchard ..... B65D 79/005 220/609
3,426,939 A * 2/1969 Young ..... B65D 1/40 220/609
3,483,908 A * 12/1969 Donovan ..... B65D 1/34 206/526
3,736,767 A * 6/1973 Lukes ..... A23G 9/221 425/439
4,076,207 A * 2/1978 Austin ..... A23G 3/0273 249/112
4,542,029 A * 9/1985 Caner ..... B65B 7/2878 206/519
4,836,398 A * 6/1989 Leftault, Jr. ..... B65D 79/005 220/609
5,695,049 A * 12/1997 Bauman ..... A45C 11/005 206/5.1
5,921,167 A * 7/1999 Giesy ..... B65D 83/0005 222/327
6,428,310 B1 * 8/2002 Nicholas G ..... C11C 5/023 249/112
6,793,193 B2 * 9/2004 de Groote ..... A23G 1/226 249/119
9,079,685 B2 * 7/2015 Sudakoff ..... B65D 21/086
9,272,444 B2 * 3/2016 Zorovich ..... B29C 33/0038
9,497,992 B2 * 11/2016 Evans ..... A24F 23/02
D777,519 S * 1/2017 Levy ..... D7/509
2003/0168372 A1 * 9/2003 Headen ..... B44F 1/10 206/459.1
2005/0017013 A1 * 1/2005 Peisach ..... B65D 1/26 220/609
2005/0229945 A1 * 10/2005 Petit ..... B65D 83/0005 132/293
2012/0181276 A1 * 7/2012 Ichikawa ..... A61J 1/03 220/200
2014/0272020 A1 * 9/2014 Wilson ..... B65D 85/72 426/115
2017/0340150 A1 * 11/2017 Chivrac ..... B65D 25/38
2017/0355510 A1 * 12/2017 Chivrac ..... B65D 25/38

* cited by examiner

CONTAINER WITH PRODUCT REMOVAL MECHANISM

BACKGROUND

1. Field of the Disclosure

The present disclosure relates to a container having a mechanism to dislodge a gelatinous or similar product therein. In particular, the container has a flexible bottom surface that can alter from a stable convex shape to a stable concave shape to dislodge contents in the container and enable extraction of the contents.

2. Description of Related Art

Products such as food stuffs, pharmaceuticals, cosmetics, clay, soft plastics, etc. having gel-like, gelatinous, solid, or semi-solid consistency are sometimes packaged in cup-shaped containers. The products may be difficult to extract from the containers without the use of a utensil, which a user may not have available. In a particular, example, alcohol in a gelatin base is sometimes packaged in a shot glass shaped container for later consumption.

Shot glasses have long existed, Primarily, shot glasses are formed from glass, often with thick walls and bottoms, and with measurement markers to denote alcohol volumes. One form of an alcoholic substance for general consumption in a shot glass is a "Jell-O®" shooter sometimes called a "Jell-O® shot." Unlike liquid drinks, Jell-O® shooters maintain a thicker, gel-like, gelatinous, or semi-solid consistency. Because of their gel-like, gelatinous, or semi-solid consistencies, these are oftentimes consumed from a shot glass by either using a spoon or slurping with a tongue. Besides traditional shot glasses made from glass, Jell-O® shooters have also be consumed in small, hard plastic or paper cups, whereby the paper cup may be crushed in conjunction with use of a spoon or tongue to extract the Jell-O® shot. Another method for consuming such shots is an oral syringe-like injectable mechanism.

Use of a spoon or other utensil can be cumbersome or impractical. Moreover, a user may not have access to any utensil. Trying to consume a Jell-O® shot with the user's tongue or fingers can be awkward, messy, and-sometimes-unsuccessful such that a spoon or knife to dislodge the Jell-O® shot from the container is required. Further, paper cups can become soggy and spill easily.

SUMMARY OF THE INVENTION

The present invention is directed to a container and method of making a container. The container includes an open top end, a sloping side wall; and a closed bottom surface. The closed bottom surface has a substantially spherical-shaped portion. The spherical-shaped portion is flexible and has a first stable position that is convex in shape and moves to a second position that is concave in shape after pressure is applied to the spherical-shaped portion.

In one embodiment, the second position is a stable position is also a stable position for the spherical-shaped portion.

The container can include a flexible hinge that connects the spherical-shape portion to the side wall. When pressure is applied to the spherical portion, the spherical-shaped portion moves from the first stable position to the second stable position.

DETAILED DESCRIPTION

The present device provides means to dislodge or extract a product from a container having one or more side walls, an open top, and closed bottom surface. The container has a larger cross-section at the top than at the bottom. The bottom surface is movable and can apply an upward force to contents of the container. When contents of the container are semi-solid such as a gel or gelatin, etc., the upward force can urge the contents upward and dislodge the contents from adherence to the side wall. The increasing cross-sectional area of the container towards the top can provide clearance to enable the contents to be extracted from the container. Accordingly, the container can enable the removal of gel-like substances from the container without the use of additional utensils. And the container can enable the removal of gel-like substances in a controlled manner. The container is suitable for food stuffs, pharmaceuticals, cosmetics, or any product with a similar consistency. The container is also suitable for any non-liquid product that can adhere to the container and be dislodged by an upward force to the bottom surface of the container.

In this application, the terms "gel-like," "gelatinous," "gelatin," and Jello®, and similar terms are used interchangeably to describe substances having substantially the same consistency. The terms "shape" and "configuration" are used interchangeably. The terms "dislodge" and "extract" are used interchangeably to mean loosening or removal of a product from the product's container.

In a particular implementation, the container can be used to dislodge or extract gelatin food products from the container. The removal of the product is a more elegant consumption than previous removal methods such as slurping with a tongue, a "White-Dress Safe" eating atmosphere, and a more suitable on-premise consumption experience that does not require a spoon or other extraction device. Moreover, a container according to the present disclosure can enable a user to extract more of the contents than prior art designs, which may leave more of the container contents within the container.

Figure 1A:
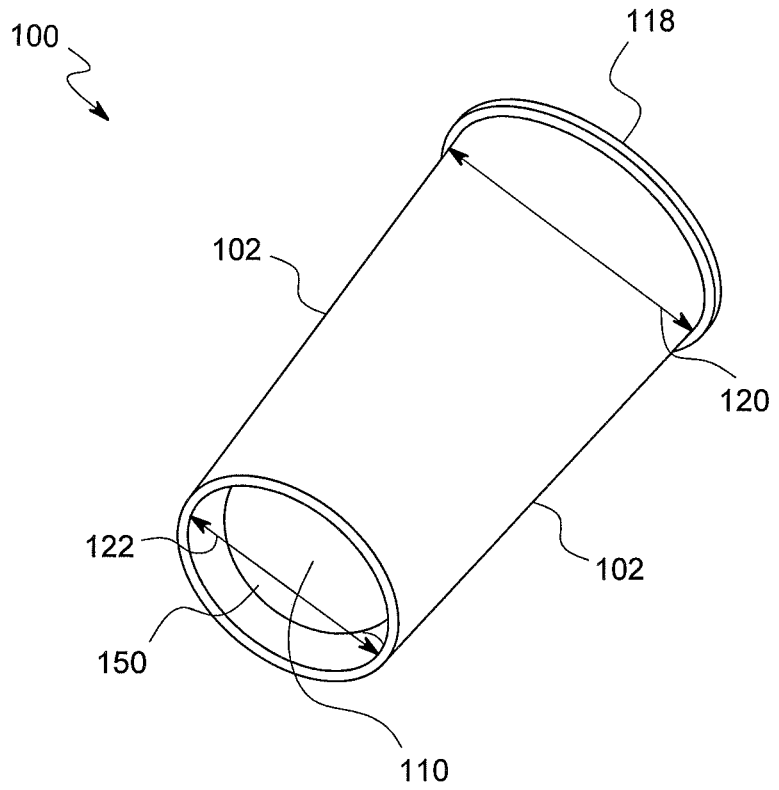
FIG. 1A illustrates a perspective view of a container according to an embodiment of the present disclosure.
Figure 1B:
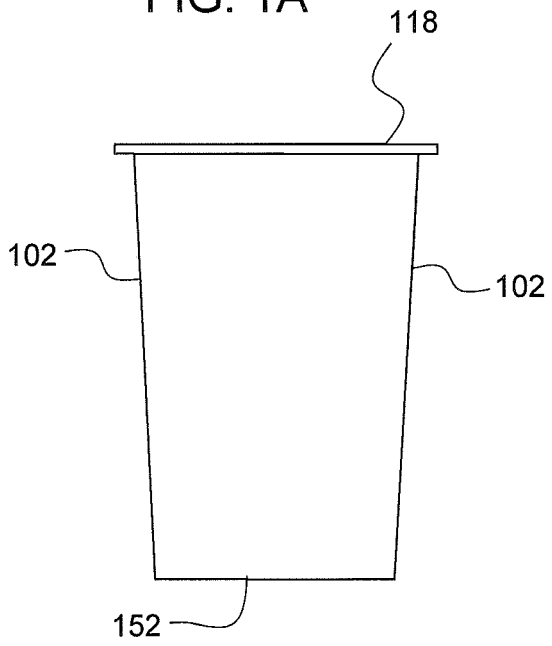
FIG. 1B illustrates a side view of the container of FIG. 1A.

FIGS. 1A-1B illustrate a perspective and side view of a container 100 according to an implementation of the disclosure. The particular implementation is similar to a shot glass commonly used in bars and restaurants. The container can be shaped substantially as a frustum of a cone with an open top end 118 and sloping side walls 102 forming a cavity therein. A bottom surface 150 has a convex spherical shape closing the bottom of the cavity. In the implementation shown in FIG. 1B, side wall 102 extends below bottom surface 150, although this is not a limitation on the design. With the side wall extending below closed surface 150 the container can be placed on a flat surface without falling over.

The frustum-shaped container open top end 118 is generally circular and the bottom surface 150 is generally circular. The diameter 120 formed by the shot container at the open top end 118 is greater than the diameter of the circle 122 at the bottom surface 150. Although FIGS. 1A, 1B present a circular opening at the top 118 and circular shape at the bottom surface 150, a container with sloping side walls further to the invention are not so limited, but could also be achieved with an oval or oval-like shape at the top open end 118 and bottom surface 150.

The container disclosed can be clear, translucent, frosted, colored, ornamented, etc. without distracting from the inventive concept. Logos, e.g., a college sports teams, emblems, paintings, company marks, sayings, etc. can be applied to the container, either through molded text in the container itself or by any commonly known method. Logos or company names or other indicia can be formed on various surfaces of the container. Similarly, the name of a pharmaceutical drug or cosmetic brand name can be formed on various surfaces of the container. Any combination of such elements can be used. For example, the side wall could be made in one color, or be translucent, while the bottom surface be made of a second, different color. A cup volume line for measurement of alcoholic quantities can be molded into or marked on a side wall.

The container can be made of any suitable material that allows for flex, but is also structurally sound to retain a stable convex position of the bottom surface and side wall. For example, such materials include a recyclable plastic, thermoplastic, and Low density polyethylene (LDPE). Material such as styrene, thermal plastic rubber (TPR), and polypropylene can be used in whole or in combination. Other suitable materials can include olefins, biorenewables, polypropylenes, polystyrenes, or any other such plastics and polymers. Other materials include thick paper or a soft-bending metallic substance, such as pure or sterling silver, or alloy, as one of ordinary skill would appreciate.

The thickness of spherical bottom surface 150 is selected for structural integrity. For example, the thickness ensures stability of the bottom surface when the bottom surface is in the convex configuration. At the same time, the thickness ensures that the bottom surface is flexible enough to be moved by an applied pressure to a concave configuration, as described below. The thickness further ensures that once the bottom surface has been altered through an applied pressure to a concave configuration, it remains in that concave configuration unless and until a pressure is applied to the concave configuration returning it to a convex configuration, as described below.

Figure 2:
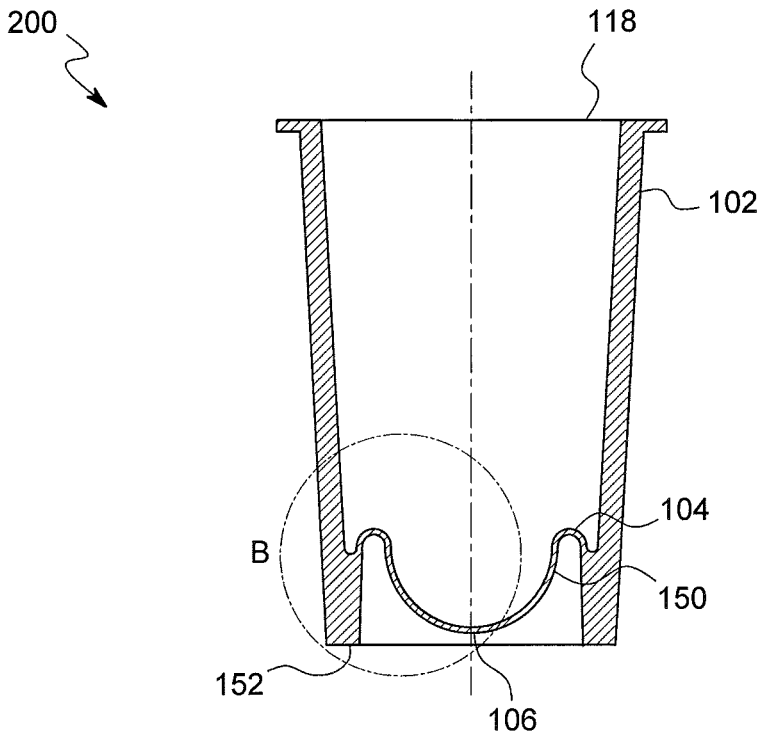
FIG. 2 illustrates a cross-sectional view of the container according to an implementation of the disclosure.

FIG. 2 illustrates a cross-sectional view 200 of a container according to the present disclosure. This cross-sectional view shows open top end 118, spherical-shaped closed bottom surface 150, and a sloping side wall 102. A flexible hinge 104 connects the side of bottom surface 150 to side wall 102. In one implementation as shown in FIG. 2, apex or lowest descent 106 of bottom surface 150 does not extend below the bottom end 152 of the side wall 102. In this implementation the container will not tip over when placed on a flat surface. However, it is not necessary for the side wall 102 to extend below the lowest descent of the spherical-shaped bottom surface 150 of the inventive container.

Figure 3:
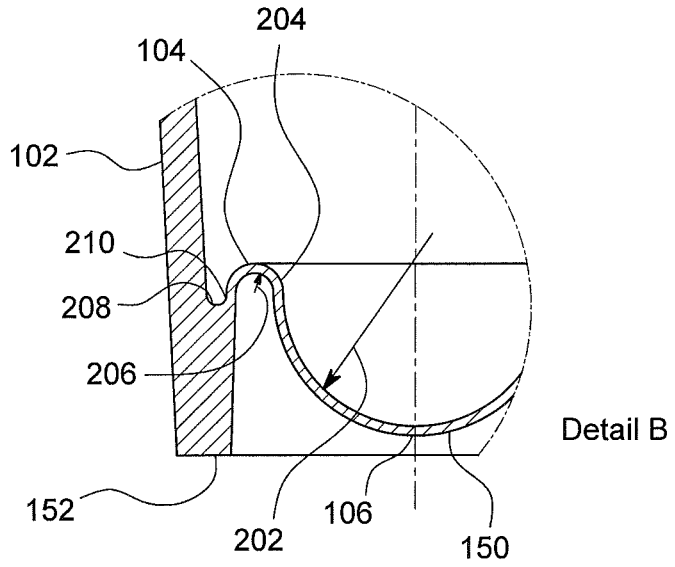
FIG. 3 illustrates a cross-sectional view of a flexible hinge and bottom surface of a container according to an implementation of the disclosure.

FIG. 3 illustrates an enlarged view of flexible hinge 104 and a portion of the spherical-shaped bottom surface 150. Spherical-shaped bottom surface 150 having a radius 202 is connected to side wall 102 by flexible hinge 104.

Flexible hinge 104 is a curved surface concave with respect to bottom surface 150 in FIG. 3 and connected on one end to bottom surface 150 at a point 204, forming a substantially continuous curve therewith. A second end 210 of flexible hinge 104 is connected to side wall 102. Second end 210 may be connected to side wall 102 by a convex curve 208, which can result in side wall 102 being thicker below the flexible hinge. The thickness of side wall 102 can be tapered to the bottom end 152 of the side wall 102.

The flexible hinge 104 and bottom surface 150 are designed so as to allow for displacement of the bottom surface 150 from a first stable convex position 110 to a second stable concave position 112 as described below in reference to FIG. 4A-4C. The flexible hinge and bottom surface also maintain stability in the second concave position.

Flexible hinge 104 is a structure connecting the bottom surface 150 to the side wall 102 and may be made of the same material as the bottom surface and side wall. Of course, flexible hinge 104 is not necessarily so limited and could be a separate, individual piece, connecting the bottom surface 150 and side wall 102 while allowing the bottom surface to flex or bend from the convex 110 to concave 112 position when pressure is applied to the bottom surface. Also, the hinge could be a liquid or gel tight flexible, interlocking joint system to inhibit leakage of contents in the container from between the side wall 102 and the bottom surface 150. The hinge 104 and bottom surface 150 could also be a singular piece that can be affixed to a second piece that forms the side wall 102 with an airtight adhesive or the like.

In one embodiment, the container is in the shape of the frustum of a cone having an overall height of between 2.5 and 3.0 inches with a top diameter 120 between 1.3 and 1.8 inches and bottom diameter 122 between 1 and 1.5 inches. The flexible hinge 104 has a thickness equal to or thinner than the thickness of the spherical-shaped bottom surface 150. In a particular implementation side wall 102 has a thickness ranging from 0.042-0.055 inches. The flexible hinge 104 has a radius between 0.05 and 0.1 inches. The spherical-shaped bottom has an angulation from the apex 106 of the spherical-shaped bottom surface 150 of about fifteen degrees. The flexible hinge 104 could have a thickness greater than the bottom surface 150 so long as the flexible hinge 104 allows the bottom surface 150 to flex or bend from a convex shape 110 to a concave shape 112 with the application of pressure. The side wall 102 can taper to be thinner at the open bottom end 118 and thicker at the side wall top end 108.

Figure 4A:
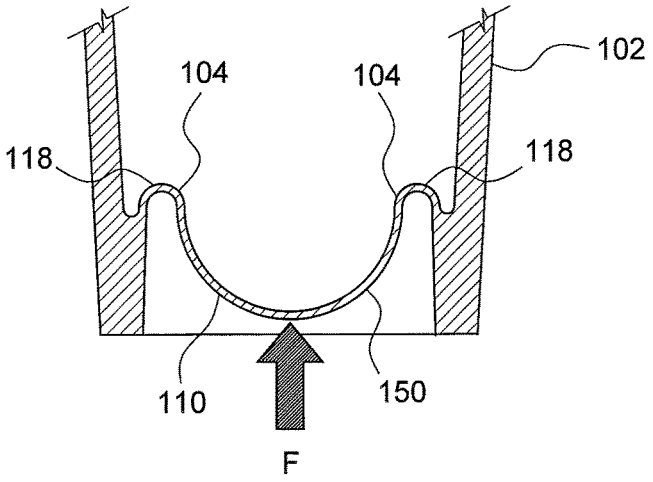
FIGS. 4A-4C are cross-sectional views illustrating the transition of a flexible hinge and bottom surface from a convex to a concave configuration in a container according to an implementation of the disclosure.
Figure 4B:
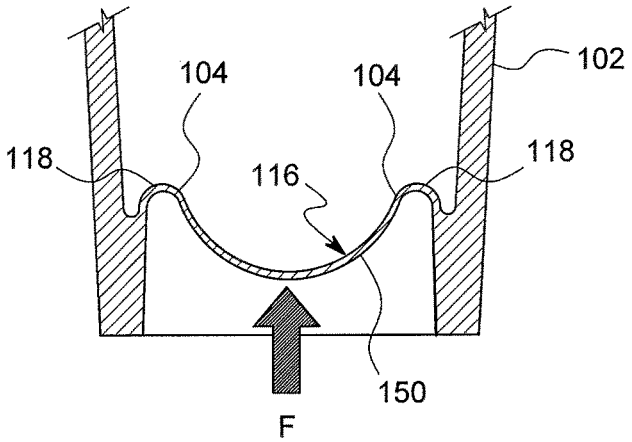
Figure 4C:
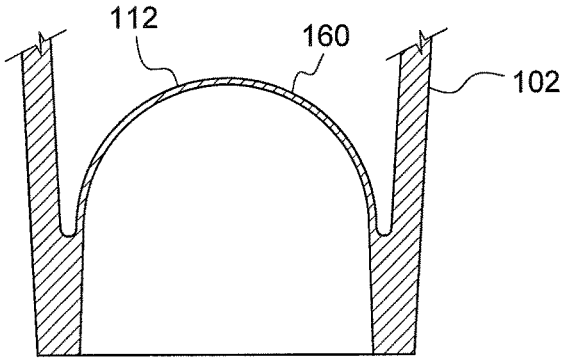

FIGS. 4A-4C illustrate a transition of bottom surface 150 from a convex shape 110 to a concave shape 112 under the influence of a force F on an embodiment of the container illustrated in FIG. 3. A feature of the hinge 104 and bottom surface 150 is that both the convex 110 and concave 112 shapes are stable. The term "stable" in the present application means the shape of the bottom surface retains its shape, without alteration, change, or movement unless acted upon by an external pressure or force. The term "unstable" means that it cannot be assured the bottom surface will remain in the stated shape. In an initial position, bottom surface 150 is in a stable, convex 110 shape as depicted in FIG. 4A. FIGS. 4B and 4C show the progression of the bottom surface 150 from the convex 110 to concave 112 position when an external pressure or force F is applied. FIG. 4B illustrates the bottom surface 150 in an intermediate, unstable position 116 transitioning from the convex 110 to concave 112 position. Hinge 104 is flexible to aid in the movement of the bottom surface. That is, the hinge can reduce the force F necessary to transition the bottom surface from the convex to the concave shape.

However, a hinge is not a requirement of the container. Those of ordinary skill can alter the thickness of the material across the bottom surface and/or the manner of connection to the side wall to aid in the transition upon application of the force.

Force F can be applied, for example, by a finger or thumb of a user pressing against the bottom surface 150 and pushing upwards against that bottom surface as depicted in FIGS. 4A-4B. The bottom surface is thereby able to bend and flex from the first stable convex 110 position to a second stable 112 concave position. When the bottom surface 150 is pushed into the second stable concave 112 position, the bottom surface in the concave 112 position does not spring back or "pop" into the first stable convex 110 position when the pressure is removed. Rather, only if downward pressure is applied to the wall of the concave 112 surface will the bottom surface 150 return to the first stable convex 110 position.

In one embodiment, the bottom surface 150 is not stable in the concave 112 position. An external pressure or force F applied to the convex position transitions the bottom surface to the concave position to dislodge the contents of the container. When the external pressure of force F is removed the elasticity of the bottom surface automatically, and without the use of external pressure or force F, returns, springs back, or "pops" the bottom surface to substantially the initial convex shape. In this embodiment, the container may be more easily refilled and reused.

In FIGS. 4A-4C, the progression of the flexible hinge 104 is shown whereby there exists a lip or protrusion 118 at the hinge when the bottom surface 150 is in a first stable convex position 110. Protrusion 118 may be considered as a portion of the hinge 104. As a pressure or force F is applied to the bottom surface 150 and the bottom surface flexes into the second stable concave position 112, the hinge 104 bends and flexes along with the bottom surface 150, allowing the bottom surface to transition from the first stable convex 110 position to the second stable concave 112 position. A person of ordinary skill in the art, however, would appreciate that hinge 104, as shown in FIGS. 4A-4C, does not necessarily have a uniform thickness. Rather, the thickness in FIGS. 4A-4C for the hinge can vary from its point of connection to the side wall 102 and to the connection with bottom surface 150 to alter the force F necessary to cause the transition in the bottom surface.

FIG. 4C illustrates the bottom surface in the stable concave shape 112. In some implementations, hinge 104 will form a continuation of the curve of the concave shape to form a dome shape 160.

It is apparent that a volume of the container is lessened when the bottom surface 150 is in the concave shape 112. Moreover, the transition of the bottom surface from the convex to the concave shape can apply a force on contents that may be within the container and operate to dislodge or vacate the contents within the container, as discussed in detail below.

Figure 5A:
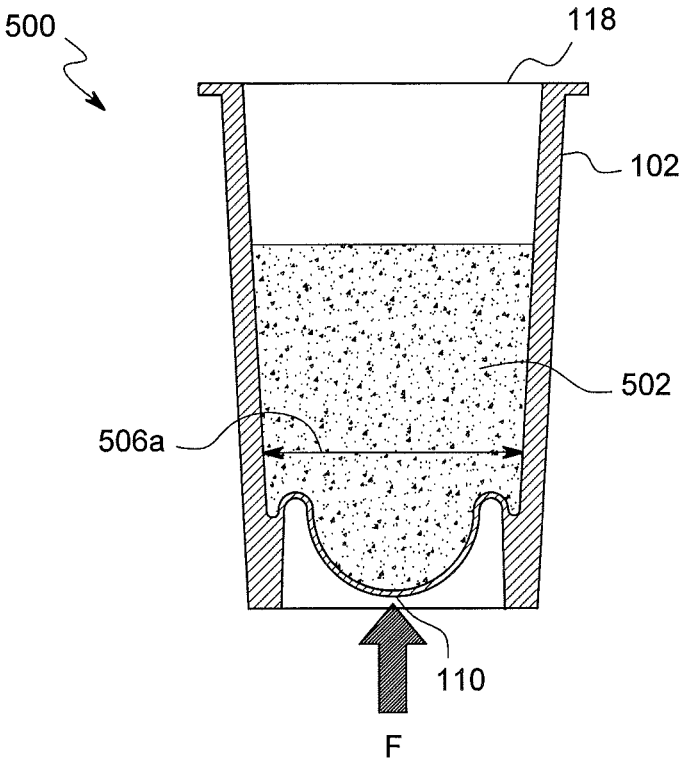
FIGS. 5A-5B illustrate a shot glass shaped container according to the present invention to dislodge or extract contents stored therein.

FIG. 5A illustrates the container 500 of the present disclosure shaped as a shot glass containing gel-like contents 502, e.g., a consumable "Jell-O® shot," which is a gelatin product having alcohol substituted for a portion of the water content.

Figure 5B:
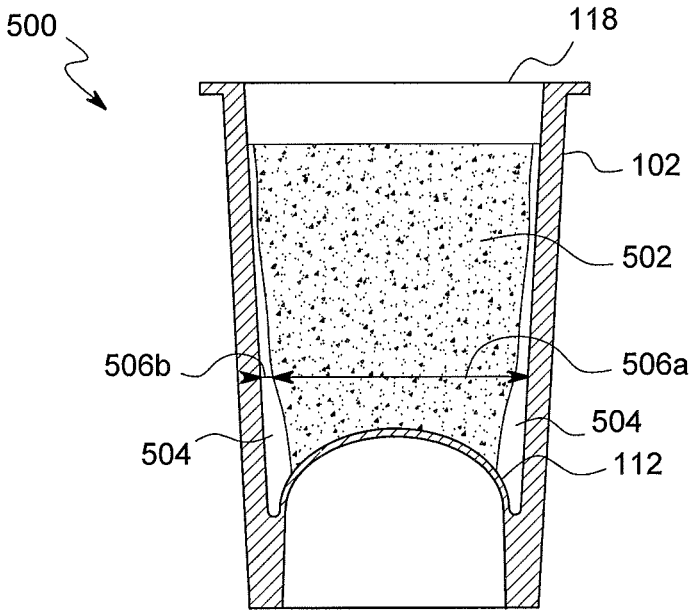

FIGS. 5A-5B illustrate a consequence of a force F applied to the convex-shaped 110 bottom surface 150 on gelatinous contents 502 within the container. A gelatinous substance substantially retains its shape. The gelatinous contents 502 has an initial diameter substantially the same as the container when the bottom surface 150 is in the convex position 110. In response to the applied force F, the bottom surface transitions to the concave position 112. The transition of the bottom surface from convex to concave pushes the gel-like contents upwards and towards the open end 118 of the container. As the gelatinous contents is pushed upward, toward opening 118, the initial diameter of the contents is less than the diameter of the container when the bottom surface is in the concave position. That is, a diameter 506*a* of the contents at an initial position is substantially the same as the diameter of the container. And the initial diameter 506*a* of the contents is less than the diameter 506*b* of the container at the later location—when the bottom surface is in the concave position. As such, the gel-like contents 502 separates from the side wall 102 creating a gap 504 between the contents and the side wall. The contents can exit the container without the need for a utensil or slurping with a tongue to dislodge the contents.

In an implementation, a lid (not shown) with hole perforations, for example, could be attached to the top of the container such that when the pushing and dislodgement occurred, ornamental "spaghetti-like" strings could be extruded and consumed for entertainment in consumption purposes. Other variations may be resultant from the movement of the contents. In another implementation, a lid without hole perforations could be attached to the top of the container so that contents do not become soiled or contaminated before consumption or use. The lid can be made of paper, metal foil, plastic, or any other suitable material.

In the particular implementation of FIGS. 5A-5B, the shot glass shaped container is filled with a Jell-O® shot contents, a substance that has a gel-like consistency. Unlike a liquid, the Jell-O® shot may not "extract" itself from the container by action of gravity, for example, when the container is tilted over. Rather, because of a thicker than liquid gelatin consistency and adhesion to the side wall 102 and bottom surface 150, the Jell-O® shot contents can stick to the shot glass shaped container and become dislodged from the bottom surface 150 and side wall 102 through the change in shape of the bottom surface from convex 110 to concave 112. As discussed above, the change in shape of the bottom surface 150 pushes the Jell-O® shot upward for easy and mess-free consumption.

The container may be made by any method known to those of ordinary skill. By way of example only, the container can be made by injection molding. Another exemplary method for making the instant invention is through co-molding injection. That is, a four-cavity injection mold can be used to mold thermoplastic material into a container having the disclosed features. A person of ordinary skill, however, would recognize that the instant container is not so limited as may be achieved by various methods that result in the claimed container. By way of non-limiting example, a metal mold may be required for part or all of a container. Moreover, a person of ordinary skill would recognize that pin locations may be needed for venting purposes during an injection mold of the instant invention. In a particular embodiment, all molding parting lines and locations on the side wall 102 are free of sinks and molding imperfections and, when physically joined to the bottom surface 150 and flexible hinge 104, appear to be one completely shot glass shaped container structure. As an alternative, component parts could include ultrasonic absorbing materials such that the side wall 102, hinge 104, and bottom wall 150, could be pressed together, fused and joined by ultrasonic welding.

While the invention has thus far been described and detailed for use as a container for a Jell-O® shooter, a person of ordinary skill in the art would realize that the invention is not so limited. Rather, its breadth reaches any application whereby a solid or semi-solid substance's dispense can be aided from the flexibility of the bottom surface in the currently pending claimed invention.

For example, medicinal dispensaries may have need for a patient to consume a gel-like or semi-solid medication with ease, convenience, and without additional utensils and possible mess. That is, a patient with arthritis who may be unable to perform detailed motions or grip a utensil might find the currently pending claimed invention especially helpful. Accordingly, further to the claimed invention, a medicine could be packaged in a container according to the claimed invention.

The invention is not necessarily limited to consumable gel-like or semi-solid substances. For example, a container having contents of a semi-solid clay or soft-solid putty can oftentimes be difficult for removal from a traditional container, especially for a small child or others having limited dexterity. Many containers require either scooping the putty out or banging the container on a hard surface to extract the contents. The disclosed container can be used to dislodge the contents without creating a mess or soiling additional utensils. As such, a container according to the current disclosure could be filled with putty, clay, or similar substance and more easily removed by a parent or child.

The invention has been illustrated and described as embodiments of the instant frustum-shaped container. However, modifications, substitutions, and changes in details of the device illustrated and its operation can be made without departing in any way from the spirit of the invention.

Other embodiments of the inventions are within the scope of the following claims.

The invention claimed is:

1. A container, comprising:

an open top end;

a sloping side wall;

a closed bottom surface, the closed bottom surface having a substantially spherical-shaped portion, wherein the spherical-shaped portion is flexible and has a first stable position that is convex in shape and moves to a second position that is concave in shape after pressure is applied to the spherical-shaped portion, and a flexible hinge that connects the spherical-shaped portion to the side wall, wherein when the spherical-shaped portion is in the convex position: (i) the flexible hinge includes a lip comprising a curved surface that is concave with respect to the closed bottom surface; (ii) a first end of the flexible hinge is connected to the spherical-shaped portion, forming a substantially continuous curve therewith, and (iii) a second end of the flexible hinge is connected to the side wall by a convex curve.

2. The container according to claim 1, wherein the second position is a stable position.

3. The container according to claim 2, wherein a lower end of the sloping side wall extends below a lowest portion of the closed bottom surface.

4. The container according to claim 2, wherein the spherical-shaped portion has uniform thickness over the entirety of the spherical-shaped portion.

5. The container according to claim 2, wherein the container is at least partially filled with a semi-solid or gelatin product.

6. The container according to claim 2, wherein the bottom surface is made of a thermoplastic or plastic material.

7. The container according to claim 2, wherein the side wall, flexible hinge, and bottom surface are made of a thermoplastic or plastic material.

8. The container according to claim 2, wherein thickness of the side wall is in the range of approximately 0.042-0.055 inches.

9. The container according to claim 2, wherein the thickness of the bottom wall is within the range of approximately 0.024-0.028 inches.

10. The container according to claim 2, wherein the thickness of the flexible hinge thickness is within the range of approximately 0.014-0.018 inches.

11. The container according to claim 2, wherein when the spherical-shaped portion is in the concave position, the flexible hinge does not have the lip, and the second end of the flexible hinge is connected to the side wall by the convex curve.

12. The container according to claim 11, wherein the flexible hinge forms part of the concave shape in the second stable position.

13. The container according to claim 2, wherein the container is a frustum of a cone, the diameter of the open top end being greater than the diameter of the bottom end.

14. The container according to claim 13, wherein a lower end of the sloping side wall extends below a lowest portion of the closed bottom surface.

15. A method of making the container for dislodging a product comprising:

forming a container body having an open top end, a sloping side wall, a flexible hinge, and a closed bottom surface, the closed bottom surface having a substantially spherical-shaped portion, wherein the spherical-shaped portion is flexible and has a first stable position that is convex in shape and moves to a second position that is concave in shape after pressure is applied to the spherical portion; and wherein the flexible hinge connects the spherical-shaped portion to the side wall, wherein when the spherical-shaped portion is in the convex position: (i) the flexible hinge includes a lip comprising a curved surface that is concave with respect to the closed bottom surface; (ii) a first end of the flexible hinge is connected to the spherical-shaped portion, forming a substantially continuous curve therewith, and (iii) a second end of the flexible hinge is connected to the side wall by a convex curve.

16. The container according to claim 15, wherein the second position is a stable position.

17. The method according to claim 16, wherein a lower end of the sloping side wall extends below a lowest portion of the closed bottom end.

18. The method according to claim 16 comprising:

filling the container body with a product.

19. The method according to claim 16, wherein when the spherical-shaped portion moves from the convex position to the concave position then the product is urged out of the container.

* * * * *